US008301451B2

(12) United States Patent
Wouters

(10) Patent No.: US 8,301,451 B2
(45) Date of Patent: Oct. 30, 2012

(54) SPEECH SYNTHESIS WITH DYNAMIC CONSTRAINTS

(75) Inventor: Johan Wouters, Zürich (CH)

(73) Assignee: Svox AG (CH)

( * ) Notice: Subject to any disclaimer, the term of this patent is extended or adjusted under 35 U.S.C. 154(b) by 703 days.

(21) Appl. No.: 12/457,911

(22) Filed: Jun. 25, 2009

(65) Prior Publication Data

US 2010/0057467 A1 Mar. 4, 2010

(30) Foreign Application Priority Data

Sep. 3, 2008 (EP) ..... 08163547

(51) Int. Cl.
*G10L 13/00* (2006.01)
*G10L 13/08* (2006.01)

(52) U.S. Cl. ..... 704/258; 704/260

(58) Field of Classification Search ..... 704/258, 704/260

See application file for complete search history.

(56) References Cited

U.S. PATENT DOCUMENTS 4,912,768 A * 3/1990 Benbassat ..... 704/260
4,956,865 A * 9/1990 Lennig et al. ..... 704/241
5,097,509 A * 3/1992 Lennig ..... 704/240
5,140,638 A * 8/1992 Moulsley et al. ..... 704/219
5,412,738 A * 5/1995 Brunelli et al. ..... 382/115
5,425,127 A * 6/1995 Yato et al. ..... 704/234
5,600,753 A * 2/1997 Iso ..... 704/200
5,682,502 A * 10/1997 Ohtsuka et al. ..... 704/267
5,749,069 A * 5/1998 Komori et al. ..... 704/240
5,893,058 A * 4/1999 Kosaka ..... 704/254
6,076,058 A * 6/2000 Chengalvarayan ..... 704/256.8
6,334,105 B1 * 12/2001 Ehara ..... 704/258
6,411,932 B1 * 6/2002 Molnar et al. ..... 704/260
6,633,843 B2 * 10/2003 Gong ..... 704/233
6,999,926 B2 * 2/2006 Yuk et al. ..... 704/244

(Continued)

OTHER PUBLICATIONS

Wouters, Johan et al., "Control of Spectral Dynamics in Concatenative Speech Synthesis" IEEE Tranactions on Speech and Audio Processing, Jan. 1, 2001, vol. 9, No. 1, IEEE Service Center, New York, XP011054070.

(Continued)

*Primary Examiner* — Eric Yen
(74) *Attorney, Agent, or Firm* — Sunstein Kann Murphy & Timbers LLP

(57) ABSTRACT

A method is disclosed for providing speech parameters to be used for synthesis of a speech utterance. In at least one embodiment, the method includes receiving an input time series of first speech parameter vectors, preparing at least one input time series of second speech parameter vectors consisting of dynamic speech parameters, extracting from the input time series of first and second speech parameter vectors partial time series of first speech parameter vectors and corresponding partial time series of second speech parameter vectors, converting the corresponding partial time series of first and second speech parameter vectors into partial time series of third speech parameter vectors, wherein the conversion is done independently for each set of partial time series and can be started as soon as the vectors of the input time series of the first speech parameter vectors have been received. The speech parameter vectors of the partial time series of third speech parameter vectors are combined to form a time series of output speech parameter vectors to be used for synthesis of the speech utterance. At least one embodiment of the method allows a continuous providing of speech parameter vectors for synthesis of the speech utterance. The latency and the memory requirements for the synthesis of a speech utterance are reduced.

22 Claims, 7 Drawing Sheets

U.S. PATENT DOCUMENTS

| | | | | |
|---|---|---|---|---|
| 7,103,540 | B2 * | 9/2006 | Droppo et al. | 704/226 |
| 7,107,210 | B2 * | 9/2006 | Deng et al. | 704/226 |
| 7,117,148 | B2 * | 10/2006 | Droppo et al. | 704/228 |
| 7,346,506 | B2 * | 3/2008 | Lueck et al. | 704/235 |
| 7,542,900 | B2 * | 6/2009 | Droppo et al. | 704/226 |
| 7,643,990 | B1 * | 1/2010 | Bellegarda | 704/211 |
| 7,848,924 | B2 * | 12/2010 | Nurminen et al. | 704/222 |
| 7,930,172 | B2 * | 4/2011 | Bellegarda | 704/211 |
| 2002/0013697 | A1 * | 1/2002 | Gong | 704/225 |
| 2006/0265444 | A1 * | 11/2006 | Shiomi et al. | 708/446 |
| 2007/0174377 | A2 * | 7/2007 | Shiomi et al. | 708/446 |
| 2007/0276666 | A1 * | 11/2007 | Rosec et al. | 704/260 |
| 2009/0048841 | A1 * | 2/2009 | Pollet et al. | 704/260 |

OTHER PUBLICATIONS

Plumpe M. et al., "HMM-Based Smoothing for Concatenative Speech Synthesis" Oct. 1, 1998, p. 908, XP007000663.

* cited by examiner static speech parameter vectors dynamic speech parameter vectors

SPEECH SYNTHESIS WITH DYNAMIC CONSTRAINTS

PRIORITY STATEMENT

The present application hereby claims priority under 35 U.S.C. §119 on European patent application number EP 08 163 547.6 filed Sep. 3, 2008, the entire contents of which are hereby incorporated herein by reference.

TECHNICAL FIELD

Embodiments of the present invention generally relate to speech synthesis technology.

BACKGROUND ART

Speech Analysis

Speech is an acoustic signal produced by the human vocal apparatus. Physically, speech is a longitudinal sound pressure wave. A microphone converts the sound pressure wave into an electrical signal. The electrical signal can be sampled and stored in digital format. For example, a sound CD contains a stereo sound signal sampled 44100 times per second, where each sample is a number stored with a precision of two bytes (16 bits).

In digital speech processing, the sampled waveform of a speech utterance can be treated in many ways. Examples of waveform-to-waveform conversion are: down sampling, filtering, normalisation. In many speech technologies, such as in speech coding, speaker or speech recognition, and speech synthesis, the speech signal is converted into a sequence of vectors. Each vector represents a subsequence of the speech waveform. The window size is the length of the waveform subsequence represented by a vector. The step size is the time shift between successive windows. For example, if the window size is 30 ms and the step size is 10 ms, successive vectors overlap by 66%. This is illustrated in FIG. 1.

The extraction of waveform samples is followed by a transformation applied to each vector. A well known transformation is the Fourier transform. Its efficient implementation is the Fast Fourier Transform (FFT). Another well known transformation calculates linear prediction coefficients (LPC). The FFT or LPC parameters can be further modified using mel warping. Mel warping imitates the frequency resolution of the human ear in that the difference between high frequencies is represented less clearly than the difference between low frequencies.

The FFT or LPC parameters can be further converted to cepstral parameters. Cepstral parameters decompose the logarithm of the squared FFT or LPC spectrum (power spectrum) into sinusoidal components. The cepstral parameters can be efficiently calculated from the mel-warped power spectrum using an inverse FFT and truncation. An advantage of the cepstral representation is that the cepstral coefficients are more or less uncorrelated and can be independently modeled or modified. The resulting parameterisation is commonly known as Mel-Frequency Cepstral Coefficients (MFCCs).

As a result of the transformation steps, the dimensionality of the speech vectors is reduced. For example, at a sampling frequency of 16 kHz and with a window size of 30 ms, each window contains 480 samples. The FFT after zero padding contains 256 complex numbers and their complex conjugate. The LPC with an order of 30 contains 31 real numbers. After mel warping and cepstral transformation typically 25 real parameters remain. Hence the dimensionality of the speech vectors is reduced from 480 to 25.

This is illustrated in FIG. 2 for an example speech utterance "Hello world". A speech utterance for "hello world" is shown on top as a recorded waveform. The duration of the waveform is 1.03 s. At a sampling rate of 16 kHz this gives 16480 speech samples. Below the sampled speech waveform there are 100 speech parameter vectors of size n=25. The speech parameter vectors are calculated from time windows with a length of 30 ms (480 samples), and the step size or time shift between successive windows is 10 ms (160 samples). The parameters of the speech parameter vectors are $25^{th}$ order MFCCs.

The vectors described so far consist of static speech parameters. They represent the average spectral properties in the windowed part of the signal. It was found that accuracy of speech recognition improved when not only the static parameters were considered, but also the trend or direction in which the static parameters are changing over time. This led to the introduction of dynamic parameters or delta features.

Delta features express how the static speech parameters change over time. During speech analysis, delta features are derived from the static parameters by taking a local time derivative of each speech parameter. In practice, the time derivative is approximated by the following regression function:

$$\Delta_{i,j} = \frac{\sum_{k=-K}^{K} k x_{i+k,j}}{\sum_{k=-K}^{K} k^2}, , \tag{1}$$

where j is the row number in the vector $x_i$ and n is the dimension of the vector $x_i$. The vector $x_{i+1}$, is adjacent to the vector $x_i$ in a training database of recorded speech.

FIG. 3 illustrates Equation (1) for K=1. The first order time derivatives of parameter vectors $x_i$ are calculated as $$\Delta_i=(x_{i+1}-x_{i-1})/2,\ i=1 \ldots m.$$

This can be written per dimension j as $$\Delta_{i,j}=(x_{i+1,j}-x_{i+1,j})/2,\ j=1 \ldots n \text{ and } n \text{ is the vector size.}$$

Additionally the delta-delta or acceleration coefficients can be calculated. These are found by taking the second time derivative of the static parameters or the first derivative of the previously calculated deltas using Equation (1). The static parameters consisting of 25 MFCCs can thus be augmented by dynamic parameters consisting of 25 delta MFCCs and 25 delta-delta MFCCs. The size of the parameter vector increases from 25 to 75.

Speech Synthesis:

Speech analysis converts the speech waveform into parameter vectors or frames. The reverse process generates a new speech waveform from the analyzed frames. This process is called speech synthesis. If the speech analysis step was lossy, as is the case for relatively low order MFCCs as described above, the reconstructed speech is of lower quality than the original speech.

In the state of the art there are a number of ways to synthesise waveforms from MFCCs. These will now be briefly summarised. The methods can be grouped as follows:

a) MLSA synthesis b) LPC synthesis c) OLA synthesis

In method (a), an excitation consisting of a synthetic pulse train is passed through a filter whose coefficients are updated at regular intervals. The MFCC parameters are converted directly into filter parameters via the Mel Log Spectral Approximation or MLSA (S. Imai, "Cepstral analysis synthesis on the mel frequency scale," Proc. ICASSP-83, pp. 93-96, April 1983).

In method (b), the MFCC parameters are converted to a power spectrum. LPC parameters are derived from this power spectrum. This defines a sequence of filters which is fed by an excitation signal as in (a). MFCC parameters can also be converted to LPC parameters by applying a mel-to-linear transformation on the cepstra followed by a recursive cepstrum-to-LPC transformation.

In method (c), the MFCC parameters are first converted to a power spectrum. The power spectrum is converted to a speech spectrum having a magnitude and a phase. From the magnitude and phase spectra, a speech signal can be derived via the inverse FFT. The resulting speech waveforms are combined via overlap and add (OLA).

In method (c), the magnitude spectrum is the square root of the power spectrum. However the information about the phase is lost in the power spectrum. In speech processing, knowledge of the phase spectrum is still lagging behind compared to the magnitude or power spectrum. In speech analysis, the phase is usually discarded.

In speech synthesis from a power spectrum, state of the art choices for the phase are: zero phase, random phase, constant phase, and minimum phase. Zero phase produces a synthetic (pulsed) sound. Random phase produces a harsh and rough sound in voiced segments. Constant phase (T. Dutoit, V. Pagel, N. Pierret, F. Bataille, O. Van Der Vreken, "The MBROLA Project: Towards a Set of High-Quality Speech Synthesizers Free of Use for Non-Commercial Purposes" Proc. ICSLP'96, Philadelphia, vol. 3, pp. 1393-1396) can be acceptable for certain voices, but remains synthetic as the phase in natural speech does not stay constant. Minimum phase is calculated by deriving LPC parameters as in (b). The result continues to sound synthetic because human voices have non-minimum phase properties.

Synthesis from a Time Series of Speech Spectral Vectors:

Speech analysis is used to convert a speech waveform into a sequence of speech parameter vectors. In speaker and speech recognition, these parameter vectors are further converted into a recognition result. In speech coding and speech synthesis, the parameter vectors need to be converted back to a speech waveform.

In speech coding, speech parameter vectors are compressed to minimise requirements for storage or transmission. A well known compression technique is vector quantisation. Speech parameter vectors are grouped into clusters of similar vectors. A pre-determined number of clusters is found (the codebook size). A distance or impurity measure is used to decide which vectors are close to each other and can be clustered together.

In text-to-speech synthesis, speech parameter vectors are used as an intermediate representation when mapping input linguistic features to output speech. The objective of text-to-speech is to convert an input text to a speech waveform. Typical process steps of text-to-speech are: text normalisation, grapheme-to-phoneme conversion, part-of-speech detection, prediction of accents and phrases, and signal generation. The steps preceding signal generation can be summarised as text analysis. The output of text analysis is a linguistic representation. For example the text input "Hello, world!" is converted into the linguistic representation [#h@-, lo_U "w3rld#], where [#] indicates silence and [,] a minor accent and ["] a major accent.

Signal generation in a text-to-speech synthesis system can be achieved in several ways. The earliest commercial systems used format synthesis, where hand crafted rules convert the linguistic input into a series of digital filters. Later systems were based on the concatenation of recorded speech units. In so-called unit selection systems, the linguistic input is matched with speech units from a unit database, after which the units are concatenated.

A relatively new signal generation method for text-to-speech synthesis is the HMM synthesis approach (K. Tokuda, T. Kobayashi and S. Imai: "Speech Parameter Generation From HMM Using Dynamic Features," in Proc. ICASSP-95, pp. 660-663, 1995; A. Acero, "Formant analysis and synthesis using hidden Markov models," Proc. Eurospeech, 1:1047-1050, 1999). In this approach, a linguistic input is converted into a sequence of speech parameter vectors using a probabilistic framework.

FIG. 4 illustrates the prediction of speech parameter vectors using a linguistic decision tree. Decision trees are used to predict a speech parameter vector for each input linguistic vector. An example linguistic input vector consists of the name of the current phoneme, the previous phoneme, the next phoneme, and the position of the phoneme in the syllable. During synthesis an input vector is converted into a speech parameter vector by descending the tree. At each node in the tree, a question is asked with respect to the input vector. The answer determines which branch should be followed. The parameter vector stored in the final leaf is the predicted speech parameter vector.

The linguistic decision trees are obtained by a training process that is the state of the art in speech recognition systems. The training process consists of aligning Hiden Markov Model (HMM) states with speech parameter vectors, estimating the parameters of the HMM states, and clustering the trained HMM states. The clustering process is based on a pre-determined set of linguistic questions. Example questions are: "Does the current state describe a vowel?" or "Does the current state describe a phoneme followed by a pause?".

The clustering is initialised by pooling all HMM states in the root node. Then the question is found that yields the optimal split of the HMM states. The cost of a split is determined by an impurity or distortion measure between the HMM states pooled in a node. Splitting is continued on each child node until a stopping criterion is reached. The result of the training process is a linguistic decision tree where the question in each node provided an optimal split of the training data.

A common problem both in speech coding with vector quantisation and in HMM synthesis is that there is no guaranteed smooth relation between successive vectors in the time series predicted for an utterance. In recorded speech, successive parameter vectors change smoothly in sonorant segments such as vowels. In speech coding the successive vectors may not be smooth because they were quantised and the distance between codebook entries is larger than the distance between successive vectors in analysed speech. In HMM synthesis the successive vectors may not be smooth because they stem from different leaves in the linguistic decision tree and the distance between leaves in the decision tree is larger than the distance between successive vectors in analysed speech.

The lack of smoothness between successive parameter vectors leads to a quality degradation in the reconstructed speech waveform. Fortunately, it was found that delta features can be used to overcome the limitations of static parameter vectors. The delta features can be exploited to perform a smoothing operation on the predicted static parameter vectors. This smoothing can be viewed as an adaptive filter where for each static parameter vector an appropriate correction is determined. The delta features are stored along with the static features in the quantisation codebook or in the leaves of the linguistic decision tree.

Conversion of Static and Delta Parameters to a Sequence of Smoothed Static Parameters:

The conversion of static and delta parameters to a sequence of smoothed static parameters is based on an algebraic derivation. Given a time series of static speech parameter vectors and a time series of dynamic speech parameter vectors, a new time series of speech parameter vectors is found that approximates the static parameter vectors and whose dynamic characteristics or delta features approximate the dynamic parameter vectors.

The algebraic derivation is expressed as follows:

Let $\{x_j\}_{1 \ldots m}$ be a time series of m static parameter vectors $x_i$ and $\{\Delta_j\}_{1 \ldots m}$ time series of m delta parameter vectors $\Delta_i$, where $x_i$ are vectors of size $n_1$ and $\Delta_i$ are vectors of size $n_2$.

Let $\{y_i\}_{1 \ldots m}$ be a time series of static parameter vectors wherein the components $y_i$ are close to the original static parameters $x_i$ according to a distance metric in the parameter space and wherein the differences $(y_{i+1}-y_{i-1})/2$ are close to $\Delta_i$.

Note that $(x_{i+1}-x_{i-1})/2$ need not be close to $\Delta_i$ because the vectors $x_i$ and $\Delta_i$ have been predicted frame by frame from a speech codebook or from a linguistic decision tree and there is no guaranteed smooth relation between successive vectors $x_i$.

The relation between $\{y_i\}_{1 \ldots m}$, $\{x_i\}_{1 \ldots m}$, and $\{\Delta_i\}_{1 \ldots m}$ is expressed by the following set of equations:

$$\begin{cases} y_{i,j} = x_{i,j} & i = 1 \ldots m, \quad j = 1 \ldots n_i \\ \dfrac{y_{i+1,j} - y_{i-1,j}}{2} = \Delta_{i,j} & i = 1 \ldots m, \quad j = 1 \ldots n_2 \end{cases} \tag{2}$$

It is assumed that $\gamma_{i+1,j}$ is zero for i=m and $\gamma_{i-1,j}$ is zero for i=1. Alternatively, the first and last dynamic constraint can be omitted in Equation (2). This leads to slightly different matrix sizes in the derivation below, without loss of generality.

If $n_1=n_2=n$, the set of equations (2) can be split into n sets, one for each dimension j.

For a given j, the matrix notation for (2) is:

$$AY_j=X_j \tag{3}$$

where

A is a 2 m by m input matrix and each entry is one of {1, −½, ½, 0}

$$Y_j=[y_{1,j} \ldots y_{i-1,j} y_{i,j} y_{i+1,j} \ldots y_{m,j}]^T \text{ is a 1 by } m \text{ vector} \tag{4}$$

$$X_j=[x_{i,j} \ldots x_{i-1,j} x_{i,j} x_{i+1,j} \ldots x_{m,j} \Delta_{1,j} \Delta_{i-1,j} \Delta_{i+1,j} \ldots \Delta_{m,j}]^T \text{ is a 1 by 2 m vector} \tag{5}$$

There is no exact solution for $Y_j$, i.e. there exists no $Y_j$ that satisfies (3). However there is a minimum least squares solution which minimises the weighted square error $$E=(X_j-AY_j)^T W_j^T W_j (X_j-AY_j), \tag{6}$$

where W is a diagonal 2 m by 2 m matrix of weights.

In HMM synthesis, the weights typically are the inverse standard deviation of the static and delta parameters:

$$w_{r,s} = \begin{cases} 0, & r \neq s \\ \dfrac{1}{\sigma_{x_{i,j}}}, & r = s = i, \quad i = 1 \ldots m \\ \dfrac{1}{\sigma_{\Delta_{i,j}}} & r = s = m+i, \quad i = 1 \ldots m \end{cases} \tag{7}$$

The solution to the weighted minimum least squares problem is:

$$Y_j=(A^T W_j^T W_j A)^{-1} A^T W_j^T W_j X_j. \tag{8}$$

Hence the state of the art solution requires an inversion of a matrix $(A^T W_j^T W_j A)$ for each dimension j. $(A^T W_j^T W_j A)$ is a square matrix of size m, where m is the number of vectors in the utterance to be synthesised. In the general case, the inverse matrix calculation requires a number of operations that increases quadratically with the size of the matrix. Due to the symmetry properties of $(A^T W_j^T W_j A)$, the calculation of its inverse is only linearly related to m.

Unfortunately, this still means that the calculation time increases as the vector sequence or speech utterance becomes longer. For real-time systems it is a disadvantage that conversion of the smoothed vectors to a waveform and subsequent audio playback can only start when all smoothed vectors have been calculated. In the state of the art each speech parameter vector is related to each other vector in the sentence or utterance through the equations in (2). Known matrix inversion algorithms require that an amount of computation at least linearly related to m is performed before the first output vector can be produced.

Numerical Considerations:

A well known problem with matrix inversion is numerical instability. Stability properties of matrix inversion algorithms are well researched in numerical literature. Algorithms such as LR and LDL decomposition are more efficient and robust against quantisation errors than the general Gaussian elimination approach.

Numerical instability becomes an even more pronounced problem when inversion has to be performed with fixed point precision rather than floating point precision. This is because the matrix inversion step involves divisions, and the division between two close large numbers returns a small number that is not accurately represented in fixed point. Since the large and small numbers cannot be represented with equal accuracy in fixed point, the matrix inversion becomes numerically unstable.

Storage of the static and delta parameters and their standard deviations is another important issue. For a codebook containing 1000 entries or a linguistic tree with 1000 leaves, the static, delta, and delta-delta parameters of size n=25 and their standard deviations bring the number of parameters to be stored to 1000×(25*3)×2=150 000. If the parameters are stored as 4 byte floating point numbers, the memory requirement is 600 kB. The memory requirement for 1000 static parameter vectors of size n=25 without deltas and standard deviations is only 100 kB. Hence six times more storage is required to store the information needed for smoothing.

SUMMARY

In view of the foregoing, the need exists for an improved providing of speech parameter vectors to be used for the synthesis of a speech utterance. More specifically, an object of at least one embodiment of the present invention is to improve at least one out of calculation time, numerical stability, memory requirements, smooth relation between successive speech parameter vectors and continuous providing of speech parameter vectors for synthesis of the speech utterance.

The new and inventive method of at least one embodiment for providing speech parameters to be used for synthesis of a speech utterance is comprising the steps of receiving an input time series of first speech parameter vectors $\{x_i\}_{1 \ldots m}$ allocated to synchronisation points 1 to m indexed by i, wherein each synchronisation point is defining a point in time or a time interval of the speech utterance and each first speech parameter vector $x_i$ consists of a number of $n_1$ static speech parameters of a time interval of the speech utterance, preparing at least one input time series of second speech parameter vectors $\{\Delta_i\}_{1 \ldots m}$ allocated to the synchronisation points 1 to m, wherein each second speech parameter vector $\Delta_i$ consists of a number of $n_2$ dynamic speech parameters of a time interval of the speech utterance, extracting from the input time series of first and second speech parameter vectors $\{x_i\}_{1 \ldots m}$ and $\{\Delta_i\}_{1 \ldots m}$ partial time series of first speech parameter vectors $\{x_i\}_{p \ldots q}$ and corresponding partial time series of second speech parameter vectors $\{\Delta_i\}_{p \ldots q}$ wherein p is the index of the first and q is the index of the last extracted speech parameter vector, converting the corresponding partial time series of first and second speech parameter vectors $\{x_i\}_{p \ldots q}$ and $\{\Delta_i\}_{p \ldots q}$ into partial time series of third speech parameter vectors $\{y_i\}_{p \ldots q}$, wherein the partial time series of third speech parameter vectors $\{y_i\}_{p \ldots q}$ approximate the partial time series of first speech parameter vectors $\{x_i\}_{p \ldots q}$, the dynamic characteristics of $\{y_i\}_{p \ldots q}$ approximate the partial time series of second speech parameter vectors $\{\Delta_i\}_{p \ldots q}$, and the conversion is done independently for each partial time series of third speech parameter vectors $\{y_i\}_{p \ldots q}$ and can be started as soon as the vectors p to q of the input time series of the first speech parameter vectors $\{x_i\}_{1 \ldots m}$ have been received and corresponding vectors p to q of second speech parameter vectors $\{\Delta_i\}_{1 \ldots m}$ have been prepared, combining the speech parameter vectors of the partial time series of third speech parameter vectors $\{y_i\}_{p \ldots q}$ to form a time series of output speech parameter vectors $\{\hat{y}_i\}_{1 \ldots m}$ allocated to the synchronisation points, wherein the time series of output speech parameter vectors $\{\hat{y}_i\}_{1 \ldots m}$ is provided to be used for synthesis of the speech utterance.

At least one embodiment of the present invention includes the synthesis of a speech utterance from the time series of output speech parameter vectors $\{\hat{y}_i\}_{1 \ldots m}$.

The step of extracting from the input time series of first and second speech parameter vectors $\{x_i\}_{1 \ldots m}$ and $\{\Delta_i\}_{1 \ldots m}$ partial time series of first speech parameter vectors $\{x_i\}_{p \ldots q}$ and corresponding partial time series of second speech parameter vectors $\{\Delta_i\}_{p \ldots q}$ allows to start with the step of converting the corresponding partial time series of first and second speech parameter vectors $\{x_i\}_{p \ldots q}$ and $\{\Delta_i\}_{p \ldots q}$ into partial time series of third speech parameter vectors $\{y_i\}_{p \ldots q}$, independently for each partial time series of third speech parameter vectors $\{y_i\}_{p \ldots q}$. The conversion can be started as soon as the vectors p to q of the input time series of the first speech parameter vectors $\{x_i\}_{1 \ldots m}$ have been received and corresponding vectors p to q of second speech parameter vectors $\{\Delta_i\}_{1 \ldots m}$ have been prepared. There is no need to receive all the speech parameter vectors of the speech utterance before starting the conversion.

By combining the speech parameter vectors of consecutive partial time series of third speech parameter vectors $\{y_i\}_{p \ldots q}$ the first part of the time series of output speech parameter vectors $\{\hat{y}_i\}_{1 \ldots m}$ to be used for synthesis of the speech utterance can be provided as soon as at least one partial time series of third speech parameter vectors $\{y_i\}_{p \ldots q}$ has been prepared. The new method allows a continuous providing of speech parameter vectors for synthesis of the speech utterance. The latency for the synthesis of a speech utterance is reduced and independent of the sentence length.

In a specific embodiment each of the first speech parameter vectors $x_i$ includes a spectral domain representation of speech, preferably cepstral parameters or line spectral frequency parameters.

In a specific embodiment the second speech parameter vectors $\Delta_i$ include a local time derivative of the static speech parameter vectors, preferably calculated using the following regression function:

$$\Delta_{i,j} = \frac{\sum_{k=-K}^{K} k x_{i+k,j}}{\sum_{k=-K}^{K} k^2},$$

where i is the index of the speech parameter vector in a time series analysed from recorded speech and j is the index within a vector and K is preferably 1. The use of these second speech parameter vectors improves the smoothness of the time series of output speech parameter vectors $\{\hat{y}_i\}_{1 \ldots m}$.

In another specific embodiment the second speech parameter vectors $\Delta_i$ include a local spectral derivative of the static speech parameter vectors, preferably calculated using the following regression function:

$$\Delta^*_{i,j} = \frac{\sum_{k=-K}^{K} k x_{i,j+k}}{\sum_{k=-K}^{K} k^2},$$

where i is the index of the speech parameter vector in a time series analysed from recorded speech and j is the index within a vector and K is preferably 1.

To further improve the smoothness of the time series of output speech parameter vectors $\{\hat{y}_i\}_{1 \ldots m}$ at least one time series of second speech parameter vectors $\Delta_i$ includes delta delta or acceleration coefficients, preferably calculated by taking the second time or spectral derivative of the static parameter vectors or the first derivative of the local time or spectral derivative of the static speech parameter vectors.

For embodiments with reduced calculation time, reduced memory requirements and increased numerical stability at least one time series of second speech parameters $\Delta_i$, consists of vectors that are zero except for entries above a predetermined threshold and the threshold is preferably a function of the standard deviation of the entry, preferably a factor $\alpha=0.5$ times the standard deviation.

In an example embodiment the step of converting is done by deriving a set of equations expressing the static and dynamic constraints and finding the weighted minimum least squares solution, wherein the set of equations is in matrix notation $$AY_{pq}=X_{pq},$$

where $Y_{pq}$ is a concatenation of the third speech parameter vectors $\{y_i\}_{p \ldots q}$, $$Y_{pq}=[y_p^T \ldots y_q^T]^T,$$

$X_{pq}$ is a concatenation of the first speech parameter vectors $\{x_i\}_{p \ldots q}$ and of the second speech parameter vectors $\{\Delta_i\}_{p \ldots q}$, $$X=[x_p^T \ldots x_q^T \Delta_p^T \ldots \Delta_q^T]^T,$$

$(\ )^T$ is the transpose operator,

M corresponds to the number of vectors in the partial time series, M=q−p+1

$Y_{pq}$ has a length in the form of the product $Mn_1$, $X_{pq}$ has a length in the form of the product $M(n_1+n_2)$, the matrix A has a size of $M(n_1+n_2)$ by $Mn_1$, the weighted minimum least squares solution is $$Y_{pq}=(A^TW^TWA)^{-1}A^TW^TWX_{pq},$$

where W is a matrix of weights with a dimension of $M(n_1+n_2)$ by $M(n_1+n_2)$.

The matrix of weights W is preferably a diagonal matrix and the diagonal elements are a function of the standard deviation of the static and dynamic parameters:

$$w_{r,s}=\begin{cases}0, & r \neq s\\ f(\sigma_{x_{i,j}}), & r=s=(i-p)n_1+j\\ f(\sigma_{\Delta_{i,j}}), & r=s=Mn_1+(i-p)n_2+j\end{cases}$$

where i is the index of a vector in $\{x_i\}_{p \ldots q}$ or $\{\Delta_i\}_{p \ldots q}$ and j is the index within a vector, M=q−p+1, and f( ) is preferably the inverse function $(\ )^{-1}$.

In order to improve the memory requirements $X_{pq}$, $Y_{pq}$, A, and W are quantised numerical matrices, wherein A and W are preferably more heavily quantised than $X_{pq}$ and $Y_{pq}$.

In order to reduce the computational load of the weighted minimum least squares solution the time series of first speech parameter vectors $\{x_i\}_{1 \ldots m}$ and the time series of second speech parameters $\{\Delta_i\}_{1 \ldots m}$ are replaced by their product with the inverse variance, and the calculation of the weighted minimum least squares solution is simplified to $Y_{pq}=(A^TW^TWA)^{-1}A^TX_{pq}$.

The calculation can be further simplified if the time series of second speech parameters include $n=n_2=n_1$ time derivatives and AY=X is split into n independent sets of equations $A_jY_j=X_j$ and preferably the matrices $A_j$ of size 2M by M are the same for each dimension j, $A_j=A$, j=1 . . . n.

In another specific embodiment the successive partial time series $\{x_i\}_{p \ldots q}$, respectively $\{\Delta_i\}_{p \ldots q}$ and $\{y_i\}_{p \ldots q}$, are set to overlap by a number of vectors and the ratio of the overlap to the length of the time series is in the range of 0.03 to 0.20, particularly 0.06 to 0.15, preferably 0.10.

The inventive solution of at least one embodiment involves multiple inversions of matrices $(A^T W^TW A)$ of size $Mn_1$, where M is a fixed number that is typically smaller than the number of vectors in the utterance to be synthesised. Each of the multiple inversions produces a partial time series of smoothed parameter vectors. The partial time series are preferably combined into a single time series of smoothed parameter vectors through an overlap-and-add strategy. The computational overhead of the pipelined calculation depends on the choice of M and the amount of overlap is typically less than 10%.

In order to get a smooth time series of output speech parameter vectors $\{\hat{y}_i\}_{1 \ldots m}$ the speech parameter vectors of successive overlapping partial time series $\{y_i\}_{p \ldots q}$ are combined to form a time series of non overlapping speech parameter vectors $\{y_i\}_{1 \ldots m}$ by applying to the final vectors of one partial time series a scaling function that decreases with time, and by applying to the initial vectors of the successive partial time series a scaling function that increases with time, and by adding together the scaled overlapping final and initial vectors, where the increasing scaling function is preferably the first half of a Hanning function and the decreasing scaling function is preferably the second half of a Hanning function.

Good results can also be found with a simpler overlapping method. The speech parameter vectors of successive overlapping partial time series $\{y_i\}_{p \ldots q}$ are combined to form a time series of non overlapping speech parameter vectors $\{\hat{y}_i\}_{1 \ldots m}$ by applying to the final vectors of one partial time series a rectangular scaling function that is 1 during the first half of the overlap region and 0 otherwise, and by applying to the initial vectors of the successive partial time series a rectangular scaling function that is 0 during the first half of the overlap region and 1 otherwise, and by adding together the scaled overlapping final and initial vectors.

At least one embodiment of the invention can be implemented in the form of a computer program comprising program code segments for performing all the steps of at least one embodiment of the described method when the program is run on a computer.

Another implementation of at least one embodiment of the invention is in the form of a speech synthesise processor for providing output speech parameters to be used for synthesis of a speech utterance, said processor comprising means for performing the steps of the described method.

DETAILED DESCRIPTION OF EXAMPLE EMBODIMENTS

Figure 1:
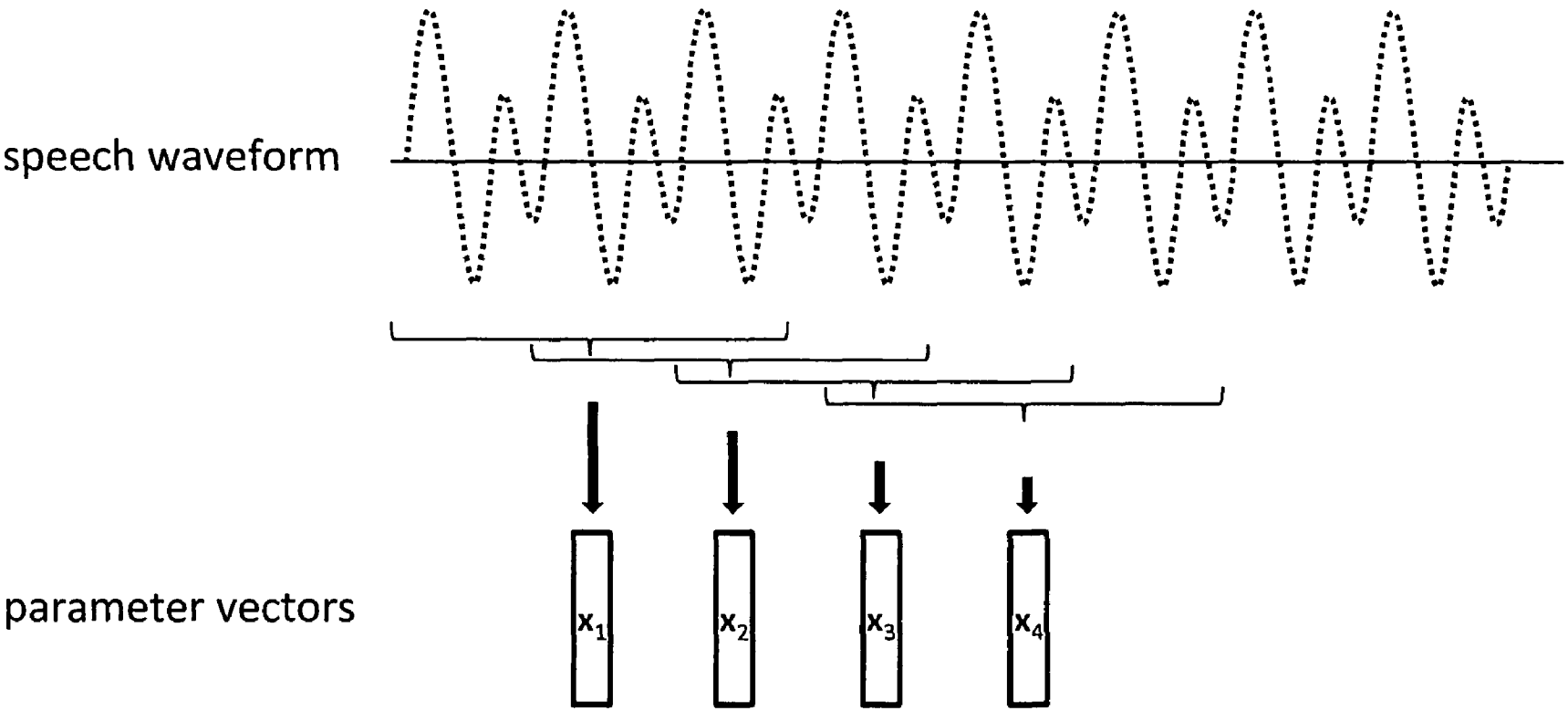
FIG. 1 shows the conversion of a time series of speech waveform samples of a speech utterance to a time series of speech parameter vectors.
Figure 2:
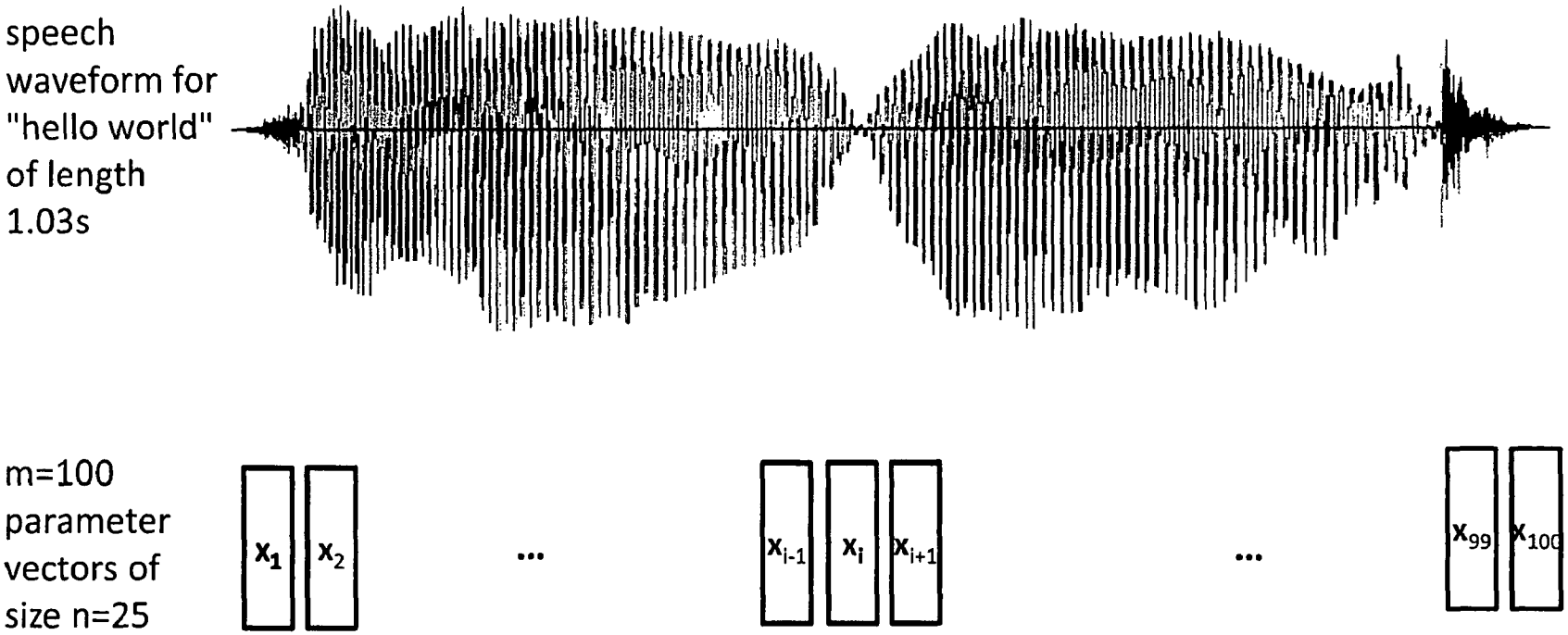
FIG. 2 illustrates conversion of an input waveform for "Hello world" into MFCC parameters
Figure 3:
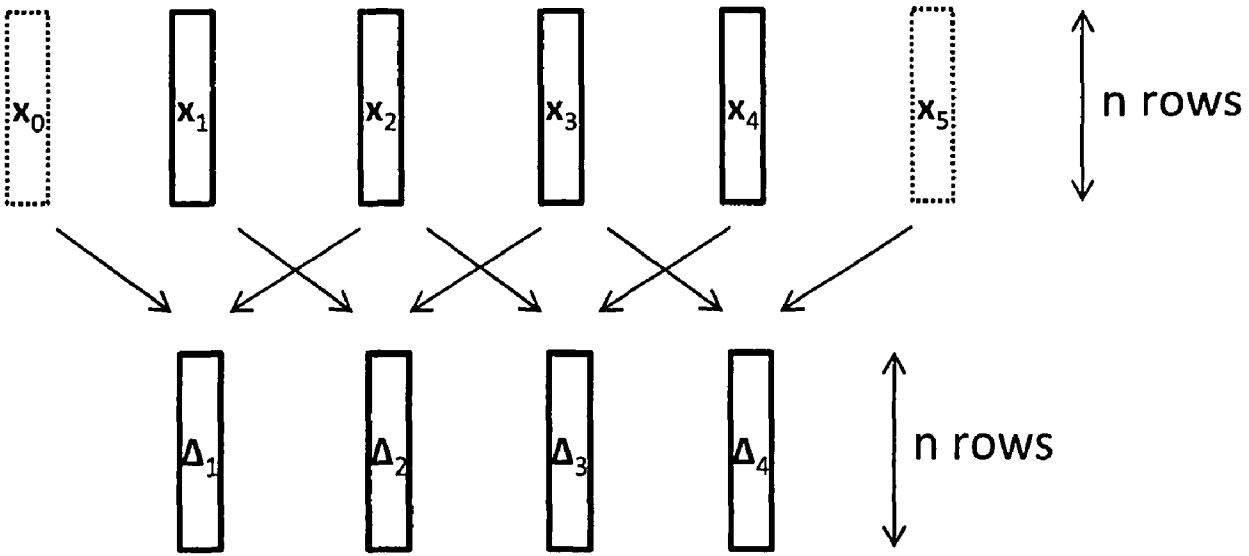
FIG. 3 shows the derivation of dynamic parameter vectors from static parameter vectors
Figure 4:
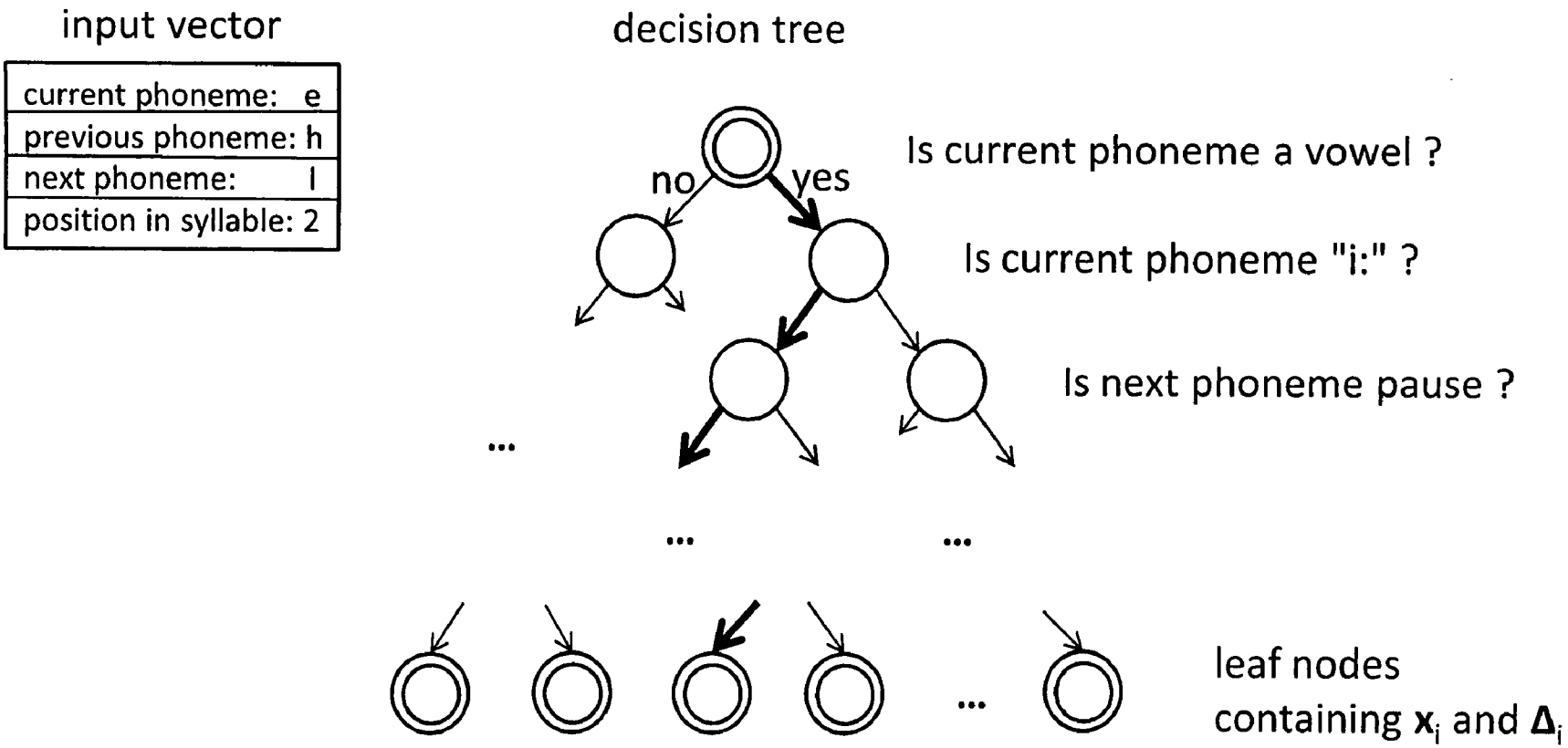
FIG. 4 illustrates the generation of speech parameter vectors using a linguistic decision tree

A state of the art algorithm to solve Equation (3) employs the LDL decomposition. The matrix $A^T W_j^T W_j A$ is cast as the product of a lower triangular matrix L, a diagonal matrix D, and an upper triangular matrix $L^T$ that is the transpose of L. Then an intermediate solution $Z_j$ is found via forward substitution of $L Z_j=A^TW_j^TW_j X_j$ and finally $Y_j$ is found via backward substitution of $L^T Y_j=D^{-1}Z_j$.

The LDL decomposition needs to be completed before the forward and backward substitutions can take place, and its computational load is linear in m. Therefore the computational load and latency to solve Equation (3) are linear in m.

Equations (3) to (5) express the relation between the input values $x_{i,j}$ and $\Delta_{i,j}$ and the outcome $y_{i,j}$, for i=1 . . . m and j=1 . . . n. In an inventive step, it was realised that $y_{i,j}$ does not change significantly for different values of $X_{i+k,j}$ or $\Delta_{i+k,j}$ when the absolute value |k| is large enough. The effect of $x_{i+k,j}$ or $\Delta_{i+k,j}$ on $y_{i,j}$ experimentally reaches zero for k≈20. This corresponds to 100 ms at a frame step size of 5 ms.

In a further inventive step, $X_j$ and $Y_j$ are split into partial time series of length M, and Equation (3) is solved for each of the partial time series. We define $\{x_{i,j}\}_{i=p \ldots q}$ as a partial time series extracted from $\{x_{i,j}\}_{i=1 \ldots m}$, where p is the index of the first extracted parameter and q is the index of the last extracted parameter, for a given dimension j. Similarly $\{\Delta_{i,j}\}_{i=p \ldots q}$ is a partial time series extracted from $\{\Delta_{i,j}\}_{i=1 \ldots m}$, where p is the index of the first extracted parameter and q is the index of the last extracted parameter, for a given dimension j. The number of parameter vectors in $\{x_i\}_{p \ldots q}$ or $\{\Delta_i\}_{p \ldots q}$ is M=q−p+1.

The computational load and the latency for the calculation of $\{y_{i,j}\}_{i=p \ldots q}$ given $\{x_{i,j}\}_{i=p \ldots q}$ and $\{\Delta_{i,j}\}_{i=p \ldots q}$ is linear in M, where M<<m. When the first time series $\{y_{i,j}\}_{i=p \ldots q}$ with p=1 and q=M has been calculated, conversion of $\{y_{i,j}\}_{i=p \ldots q}$ to a speech waveform and audio playback can take place. During audio playback of the first smoothed time series the next smoothed time series can be calculated. Hence the latency of the smoothing operation has been reduced from one that depends on the length m of the entire sentence to one that is fixed and depends on the configuration of the system variable M.

For p>1 and q<m, the first and last k≈20 entries of $\{y_{i,j}\}_{i=p \ldots q}$ are not accurate compared to the single step solution of Equation (4). This is because the values of $x_i$ and $\Delta_i$ preceding p and following q are ignored in the calculation of $\{y_{i,j}\}_{i=p \ldots q}$. In a further inventive step, the partial time series $\{X_{i,j}\}_{i=p \ldots q}$ and $\{\Delta_{i,j}\}_{i=p \ldots q}$ of length M are set to overlap.

Figure 5:
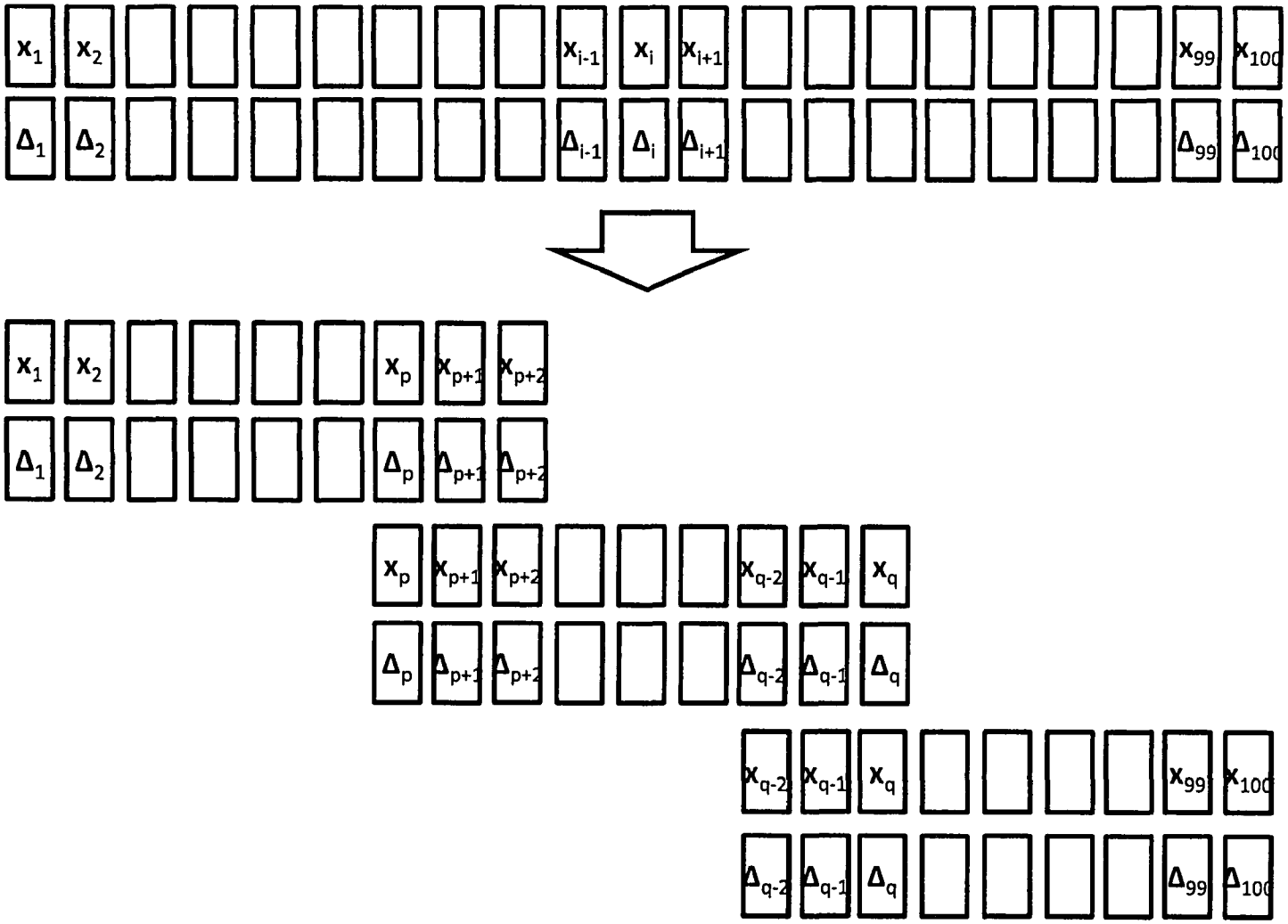
FIG. 5 illustrates the extraction of overlapping partial time series of static speech parameter vectors $\{x_i\}_{p \ldots q}$ and of dynamic speech parameter vectors $\{\Delta_i\}_{p \ldots q}$ from input time series of static and dynamic speech parameter vectors $\{x_i\}_{1 \ldots m}$ and $\{\Delta_i\}_{1 \ldots m}$

FIG. 5 illustrates the extraction of partial overlapping time series from time series of speech parameter vectors $\{x_i\}_{1 \ldots 100}$ and $\{\Delta_i\}_{1 \ldots 100}$. If a constant non-zero overlap of O vectors is chosen, the overhead or total amount of extra calculation compared to the single step solution of equation (3) is O/M. For example, if M=200 and O=20, the extra amount of calculation is 10%.

Figure 6:
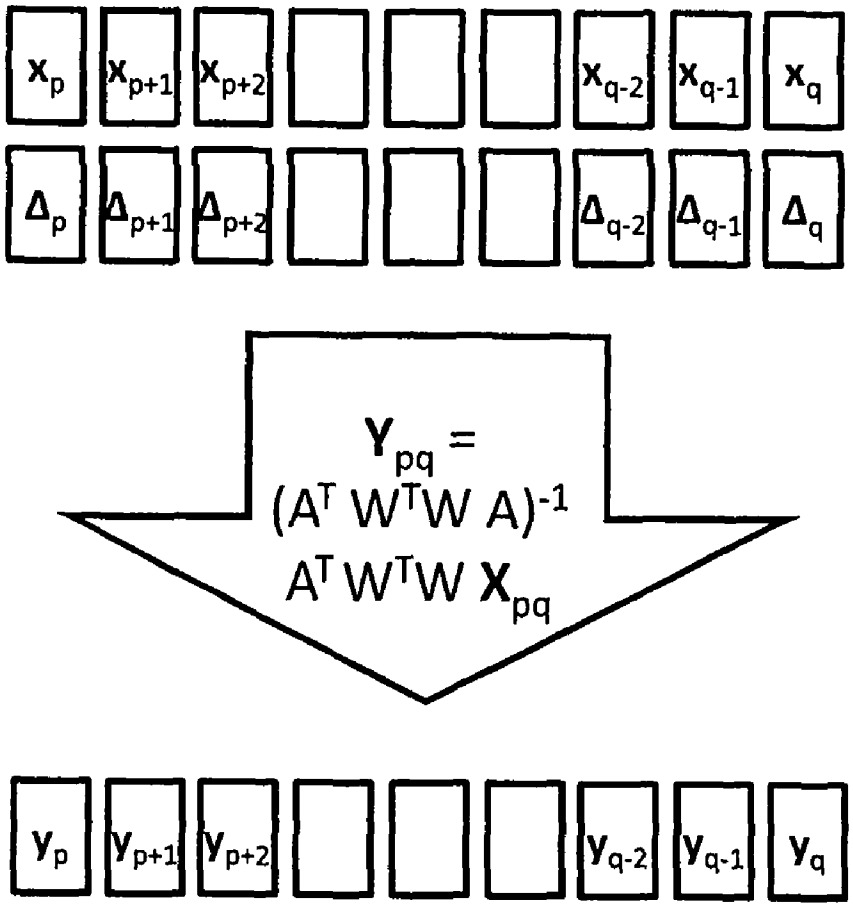
FIG. 6 illustrates the conversion of a time series of static speech parameter vectors $\{x_i\}_{p \ldots q}$ and a corresponding time series of dynamic speech parameter vectors $\{\Delta_i\}_{p \ldots q}$ to a time series of smoothed speech parameter vectors $\{y_i\}_{p \ldots q}$ by means of an algebraic operation.

FIG. 6 illustrates the conversion of a time series of static speech parameter vectors $\{x_i\}_{p \ldots q}$ and a corresponding time series of dynamic speech parameter vectors $\{\Delta_i\}_{p \ldots q}$ to a time series of smoothed speech parameter vectors $\{y_i\}_{p \ldots q}$ by means of the algebraic operation $$Y_{pq}=(A^TW^TWA)^{-1}A^TW^TWX_{pq}.$$

In a further inventive step, the overlapping $\{y_{i,j}\}_{i=p \ldots q}$ are combined into a non-overlapping time series of output smoothed vectors $\{\hat{y}_{i,j}\}_{i=1 \ldots m}$ using an overlap-and-add technique. Hanning, linear, and rectangular windowing shapes were experimented with. The Hanning and linear windows correspond to cross-fading; in the overlap region 0 the contribution of vectors from a first time series are gradually faded out while the vectors from the next time series are faded in.

Figure 7:
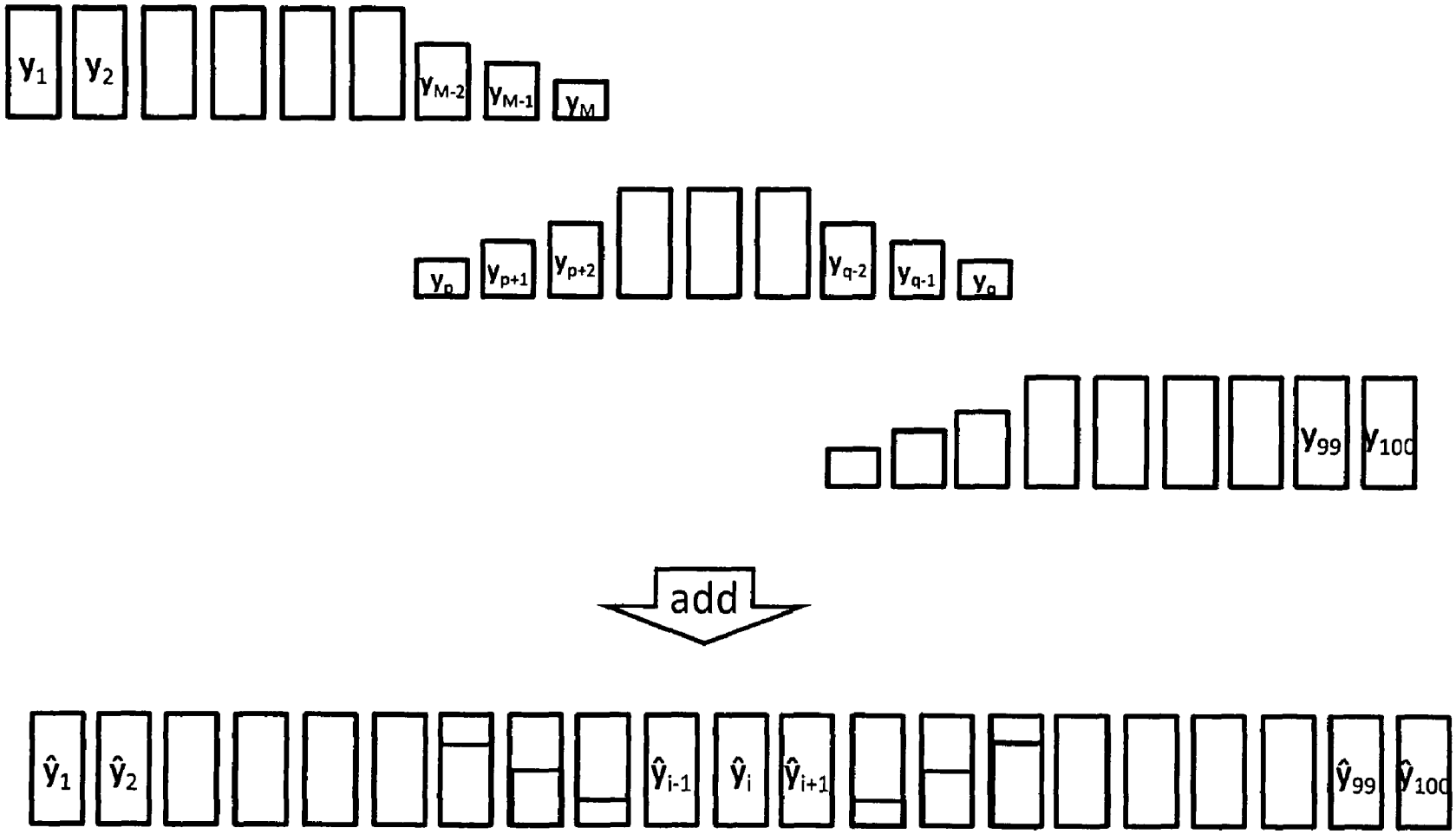
FIG. 7 illustrates the combination through overlap-and-add of partial time series $\{y_i\}_{p \ldots q}$ to a non-overlapping time series $\{\hat{y}_i\}_{1 \ldots m}$

FIG. 7 illustrates the combination of partial overlapping time series into a single time series. The shown combination uses overlap-and-add of three overlapping partial time series to a time series of speech parameter vectors $\{\hat{y}_i\}_{1 \ldots 100}$.

In comparison, rectangular windows keep the contribution from the first time series until halfway the overlap region and then switch to the next time series. Rectangular windows are preferred since they provide satisfying quality and require less computation than other window shapes.

The input for the calculation of $\{y_{i,j}\}_{i=p \ldots q}$ are the static speech parameter vectors $\{x_{i,j}\}_{i=p \ldots q}$ and the dynamic speech parameter vectors $\{\Delta_{i,j}\}_{i=p \ldots q}$, as well as their standard deviations, on which the weights $w_{r,s}$ are based according to Equation (7). In a speech coding or speech synthesis application these input parameters are retrieved from a codebook or from the leaves of a linguistic decision tree.

To reduce storage requirements, in one embodiment of the invention the fact is exploited that the deltas are an order of magnitude smaller than the static parameters, but have roughly the same standard deviation. This results from the fact that the deltas are calculated as the difference between two static parameters. A statistical test can be performed to see if a delta value is significantly different from 0. We accept the hypothesis that $\Delta_{i,j}=0$ when $|\Delta_{i,j}|<\alpha\sigma_{i,j}$, where $\sigma_{i,j}$ is the standard deviation of $\Delta_{i,j}$ and $\alpha$ is a scaling factor determining the significance level of the test. For $\alpha=0.5$ the probability that the null hypothesis can be accepted is 95% (i.e. significance level p=0.05). We found that only a small fraction of the $\Delta_{i,j}$ are significantly different from 0 and need to be stored, reducing the memory requirements for the deltas by about a factor 10.

In another embodiment of the invention, the codebook or linguistic decision tree contains $x_i$ and $\Delta_i$ multiplied by their inverse variance rather than the values $x_i$ and $\Delta_i$ themselves. Then Equation (8) can be simplified to $Y_j=(A^T W_j^T W_j A)^{-1} A^T X_j$, where $W_j^T W_j$ is absorbed in $X_j$. This saves computation cost during the calculation of $Y_j$.

In another embodiment of the invention, the inverse variances $\sigma_{i,j}^{-2}$ are quantised to 8 bits plus a scaling factor per dimension j. The 8 bits (256 levels) are sufficient because the inverse variances only express the relative importance of the static and dynamic constraints, not the exact cepstral values. The means multiplied by the quantised inverse variances are quantised to 16 bits plus a scaling factor per dimension j.

In the equations presented so far, $\{y_{i,j}\}_{i=p \ldots q}$ is calculated separately for each dimension j. This is possible if the dynamic constraints $\Delta_{i,j}$ represent the change of $x_{i,j}$ between successive data points in the time series. In one embodiment of the invention, parameter smoothing can be omitted for high values of j. This is motivated by the fact that higher cepstral coefficients are increasingly noisy also in recorded speech. It was found that about a quarter of the cepstral trajectories can remain unsmoothed without significant loss of quality.

In another embodiment of the invention, the dynamic constraints can also represent the change of $x_{i,j}$ between successive dimensions j. These dynamic constraints can be calculated as:

$$\Delta_{i,j}^{*} = \frac{\sum_{k=-K}^{K} k x_{i,j+k}}{\sum_{k=-K}^{K} k^2},$$

where K is preferably 1. Dynamic constraints in both time and parameter space were introduced for Line Spectral Frequency parameters in (J. Wouters and M. Macon, "Control of Spectral Dynamics in Concatenative Speech Synthesis", in IEEE Transactions on Speech and Audio Processing, vol. 9, num. 1, pp. 30-38, January, 2001), the entire contents of which are hereby incorporated herein by reference.

With the introduction of dynamic constraints in the parameter space, the set of equations in (2) can no longer be split into n independent sets. Rather, the vector X is defined which is a concatenation of the parameter vectors $\{x_i\}_{1 \ldots m}$ and $\{\Delta_i\}_{1 \ldots m}$, and Y is defined which is a concatenation of the parameter vectors $\{y_i\}_{1 \ldots m}$. Then the set of equations in (2) is written in matrix notation as AY=X, where A is a matrix of size 2 mn by mn. By use of the inventive steps described previously, the latency can be made independent from the sentence length by dividing the input into partial overlapping time series of vectors $\{x_i\}_{p \ldots q}$, and $\{\Delta_i\}_{p \ldots q}$, and solving partial matrix equations of size 2 Mn by Mn, where M=q−p+1.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, computer readable medium and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable medium and is adapted to perform any one of the aforementioned methods when run on a computer device (a device including a processor). Thus, the storage medium or computer readable medium, is adapted to store information and is adapted to interact with a data processing facility or computer device to execute the program of any of the above mentioned embodiments and/or to perform the method of any of the above mentioned embodiments.

The computer readable medium or storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A computer-implemented method for synthesizing a speech utterance, the method comprising: performing, by a processor, operations of:

receiving an input time series of m first speech parameter vectors $\{x_i\}_{1 \ldots m}$, wherein:

index i takes on values from 1 to m;

each first speech parameter vector $x_i$ corresponds to an identically indexed one of m synchronization points, which are also indexed by i;

each synchronization point defines at least one of a point in time and a time interval of the speech utterance; and each first speech parameter vector $x_i$ includes a first number $n_1$ of static speech parameters of a time interval of the speech utterance;

preparing at least one input time series of m second speech parameter vectors $\{\Delta_i\}_{1 \ldots m}$, wherein:

each second speech parameter vector $\Delta_i$ corresponds to an identically indexed one of the synchronisation points; and each second speech parameter vector $\Delta_i$ includes a second number $n_2$ of dynamic speech parameters of a time interval of the speech utterance;

extracting from the input time series of first speech parameter vectors $\{x_i\}_{1 \ldots m}$ a partial time series of first speech parameter vectors $\{x_i\}_{p \ldots q}$, wherein:

p is the index of the first of the extracted first speech parameter vectors;

q is the index of the last of the extracted first speech parameter vectors; and the partial time series of first speech parameter vectors $\{x_i\}_{p \ldots q}$ is a proper subset of the input time series of first speech parameter vectors $\{x_i\}_{1 \ldots m}$;

extracting from the input time series of second speech parameter vectors $\{\Delta_i\}_{1 \ldots m}$ a partial time series of second speech parameter vectors $\{\Delta_i\}_{p \ldots q}$, wherein:

each vector $\Delta_i$ of the partial time series of second speech parameter vectors corresponds to an identically indexed vector $x_i$ in the partial time series of first speech parameter vectors;

converting the partial time series of first speech parameter vectors $\{x_i\}_{p \ldots q}$ and the partial time series of second speech parameter vectors $\{\Delta_i\}_{p \ldots q}$ into a partial time series of corresponding third speech parameter vectors $\{y_i\}_{p \ldots q}$, so as to:

minimize differences between respective third speech parameter vectors $y_i$ of the partial time series of third speech parameter vectors $\{y_i\}_{p \ldots q}$ and their corresponding first speech parameter vectors $x_i$ of the partial time series of first speech parameter vectors $\{x_i\}_{p \ldots q}$; and minimize differences of dynamic characteristics between respective third speech parameter vectors $y_i$ of the partial time series of third speech parameter vectors $\{y_i\}_{p \ldots q}$ and their corresponding second speech parameter vectors $\Delta_i$ of the partial time series of second speech parameter vectors $\{\Delta_i\}_{p \ldots q}$;

wherein the conversion of the partial time series of first speech parameter vectors $\{x_i\}_{p \ldots q}$ and the partial time series of second speech parameter vectors $\{\Delta_i\}_{p \ldots q}$ is performed independent of converting any other first speech parameter vector $\{x_i\}_{1 \ldots p-1, q+1 \ldots m}$; and synthesizing a speech utterance from the time series of third speech parameter vectors $\{y_i\}_{p \ldots q}$.

2. A method according to claim 1, wherein each of the first speech parameter vectors $x_i$ includes a spectral domain representation of speech.

3. A method according to claim 1, wherein at least one series of second speech parameter vectors of the at least one input time series of m second speech parameter vectors $\{\Delta_i\}_{1 \ldots m}$ includes a local time derivative of the first speech parameter vectors a regression function:

$$\Delta_{i,j} = \left(\sum_{k=-K}^{K} k x_{i+k,j}\right) \Big/ \left(\sum_{k=-K}^{K} k^2\right),$$

where i is the index of the first speech parameter vector in a time series analysed from recorded speech and j is an index within the vector.

4. A method according to claim 1, wherein at least one series of second speech parameter vectors of the at least one input time series of second speech parameter vectors $\{\Delta_i\}_{1 \ldots m}$ includes a local spectral derivative of the first speech parameter vectors calculated using a regression function:

$$\Delta^*_{i,j} = \left(\sum_{k=-K}^{K} k x_{i,j+k}\right) \Big/ \left(\sum_{k=-K}^{K} k^2\right),$$

where i is the index of the first speech parameter vector in a time series analysed from recorded speech and j is an index within the vector.

5. A method according to claim 1, wherein at least one time series of second speech parameter vectors $\Delta_i$ includes at least one of:

delta delta calculated by taking at least one of:

a second time derivative of at least one parameter in the first speech parameter vectors;

a second spectral derivative of at least one parameter in the first speech parameter vectors;

a first derivative of a local time derivative of at least one parameter in the first speech parameter vectors; and a first derivative of a spectral derivative of at least one parameter in the first speech parameter vectors.

6. A method according to claim 1, further comprising storing zeros in entries of the vectors of the time series of second speech parameters $\{\Delta_i\}$, where the entries would otherwise contain values below predetermined threshold values, the threshold values being functions of standard deviations of the entries.

7. A method according to claim 1, wherein the converting comprises deriving a set of equations expressing static and dynamic constraints and finding a weighted minimum least squares solution, wherein the set of equations is, in matrix notation:

$$AY_{pq}=X_{pq},$$

where $Y_{pq}$ comprises a concatenation of the third speech parameter vectors $\{y_i\}_{p \ldots q}$, $$Y_{pq}[y_p^T \ldots x_q^T]^T,$$

$X_{pq}$ comprises a concatenation of the first speech parameter vectors $\{x_i\}_{p \ldots q}$ and the second speech parameter vectors $\{\Delta_i\}_{p \ldots q}$, $$Y_{pq}[x_p^T \ldots x_q^T \Delta_p^T \ldots \Delta_q^T]^T,$$

$(\ )^T$ represents a transpose operator,

M corresponds to a length of a partial time series, $M=q-p+1$, $Y_{pq}$ has a length in a form of a product $Mn_1$, $X_{pq}$ has a length in a form of a product $M(n_1+n_2)$, the matrix A has a size of $M(n_1+n_2)$ by $Mn_1$, and the weighted minimum least squares solution is $$Y_{pq}=(A^TW^TWA)^{-1}A^TW^TWX_{pq},$$

where W is a matrix of weights with a dimension of $M(n_1+n_2)$ by $M(n_1+n_2)$.

8. A method according to claim 7, wherein the matrix W of weights comprises a diagonal matrix and values of diagonal elements of the matrix W are a function of a standard deviation of static and dynamic parameters:

$$w_{r,s} = \begin{cases} 0, & r \neq s \\ f_{(\sigma_{x_{i,j}})}, & r = s = (i-p)n_1 + j \\ f_{(\sigma_{\Delta_{i,j}})}, & r = s = Mn_1 + (i-p)n_2 + j \end{cases}$$

where i is the index of a vector in $\{x_i\}_{p \ldots q}$, j is an index within a vector, $M=q-p+1$, and f( ) comprises an inverse function $(\ )^{-1}$.

9. A method according to claim 8, wherein $X_{pq}$, $Y_{pq}$, A, and W are quantised numerical matrices, and A and W are more heavily quantised than $X_{pq}$ and $Y_{pq}$.

10. A method according to claim 8, further comprising:

multiplying values of $x_i$ in the received time series of first speech parameter vectors $\{x_i\}_{1 \ldots m}$ by their inverse variance; and multiplying values of $\Delta_i$ in the prepared at least one time series of second speech parameter vectors $\{\Delta_i\}_{1 \ldots m}$ by their inverse variance;

wherein the weighted minimum least squares solution is $Y_{pq}=(A^T W^T W A)^{-1} A^T X_{pq}$.

11. A method according to claim 7, wherein:

each of the at least one time series of second speech parameters includes $n=n_2=n_1$ time derivatives; and $AY=X$ comprises n independent sets of equations $A_jY_j=X_j$.

12. A method according to claim 1, further comprising:

repeating:

the extracting of a partial time series of first speech parameters $\{x_i\}_{p \ldots q}$;

the extracting of a partial time series of second speech parameter vectors $\{\Delta_i\}_{p \ldots q}$; and the converting of the partial time series of first speech parameter vectors and the partial series of second speech parameter vectors into a partial time series of third speech parameter vectors $\{y_i\}_{p \ldots q}$;

wherein each repetition is performed using a successive value of p, thereby producing a plurality of successive partial time series of third speech parameter vectors; and combining the plurality of successive partial time series of third speech parameter vectors to form a time series of output speech parameter vectors $\{\hat{y}_i\}_{1 \ldots m}$, wherein each output speech parameter vector $\hat{y}_i$ corresponds to an identically indexed one of the synchronisation points;

wherein the synthesizing of the speech utterance comprises synthesizing the speech utterance from the time series of output speech parameter vectors $\{\hat{y}_i\}_{1 \ldots m}$.

13. A method according to claim 12, wherein:

for each repletion, p and q are such that the partial time series of first speech parameter vectors $\{x_i\}_{p \ldots q}$, the partial time series of second speech parameter vectors $\{\Delta_i\}_{p \ldots q}$ and the partial time series of corresponding third speech parameter vectors $\{y_i\}_{p \ldots q}$ overlap each other by a non-zero number of vectors; and the combining the plurality of successive partial time series of third speech parameter vectors comprises forming a non-overlapping time series of output speech parameter vectors $\{\hat{y}_i\}_{1 \ldots m}$, including, for each of at least some of the plurality of successive partial time series of third speech parameter vectors:

applying to final vectors of the partial time series of third speech parameter vectors a first scaling function that decreases with time;

applying to initial vectors of an immediately successive partial time series of third speech parameter vectors a second scaling function that increases with time; and adding together the scaled overlapping final and initial vectors.

14. A method according to claim 12, wherein:

for each repletion, p and q are such that the partial time series of first speech parameter vectors $\{x_i\}_{p \ldots q}$, the partial time series of second speech parameter vectors $\{\Delta_i\}_{p \ldots q}$ and the partial time series of corresponding third speech parameter vectors $\{y_i\}_{p \ldots q}$ overlap each other by a non-zero number of vectors; and the combining the plurality of successive partial time series of third speech parameter vectors comprises forming a non-overlapping time series of output speech parameter vectors $\{\hat{y}_i\}_{1 \ldots m}$, including for each of at least some of the plurality of successive partial time series of third speech parameter vectors:

applying to final vectors of the partial time series of third speech parameter vectors a first rectangular scaling function equals about 1 during a first half of an overlap region and about 0 otherwise; and applying to initial vectors of an immediately successive partial time series of third speech parameter vectors a second rectangular scaling function that equals about 0 during the first half of the overlap region and about 1 otherwise; and adding together the scaled overlapping final and initial vectors.

15. A method according to claim 1, further comprising:

repeating:

the extracting of a partial time series of first speech parameters $\{x_i\}_{p \ldots q}$;

the extracting of a partial time series of second speech parameter vectors $\{\Delta_i\}_{p \ldots q}$;

the converting the partial time series of first speech parameter vectors and the partial series of second speech parameter vectors into a partial time series of third speech parameter vectors $\{y_i\}_{p \ldots q}$; and the synthesizing of a speech utterance from the time series of third speech parameter vectors;

wherein each repetition is performed using a successive value of p.

16. A method according to claim 12, wherein:

for each repletion, p and q are such that the partial time series of first speech parameter vectors $\{x_i\}_{p \ldots q}$, the partial time series of second speech parameter vectors $\{\Delta_i\}_{p \ldots q}$ and the partial time series of corresponding third speech parameter vectors $\{y_i\}_{p \ldots q}$ overlap each other by a number of vectors; and a ratio of the overlap to a length of any one of the partial time series of speech parameter vectors is in a range of about 0.03 to about 0.20.

17. A method according to claim 2, wherein each of the first speech parameter vectors $x_i$ includes at least one of cepstral parameters and line spectral frequency parameters.

18. A method according to claim 6, wherein the function includes multiplying the standard deviation by about 0.5.

19. A method according to claim 11, wherein:

each matrices $A_j$ is of size 2M by M; and for each dimension j=1 . . . n, all the matrices $A_j$ are identical.

20. A method according to claim 13, wherein the first scaling function comprises a first half of a Hanning function, and the second scaling function comprises a second half of a Hanning function.

21. A computer program product for synthesizing a speech utterance, the computer program product comprising a non-transitory computer-readable medium having computer readable program code stored thereon, the computer readable program configured to:

receive an input time series of m first speech parameter vectors $\{x_i\}_{1 \ldots m}$, wherein:

index i takes on values from 1 to m;

each first speech parameter vector $x_i$ corresponds to an identically indexed one of m synchronization points, which are also indexed by i;

each synchronization point defines at least one of a point in time and a time interval of the speech utterance; and each first speech parameter vector $x_i$ includes a first number $n_1$ of static speech parameters of a time interval of the speech utterance;

prepare at least one input time series of m second speech parameter vectors $\{\Delta_i\}_{1 \ldots m}$, wherein:

each second speech parameter vector $\Delta_i$ corresponds to an identically indexed one of the synchronization points; and each second speech parameter vector $\Delta_i$ includes a second number $n_2$ of dynamic speech parameters of a time interval of the speech utterance;

extract from the input time series of first speech parameter vectors $\{x_i\}_{1 \ldots m}$ a partial time series of first speech parameter vectors $\{x_i\}_{p \ldots q}$, wherein:

p is the index of the first extracted first speech parameter vectors;

q is the index of the last of the extracted first speech parameter vectors; and the partial time series of first speech parameter vectors $\{x_i\}_{p \ldots q}$ is a proper subset of the input time series of first speech parameter vectors $\{x_i\}_{1 \ldots m}$;

extract from the input time series of second speech parameter vectors $\{\Delta_i\}_{1 \ldots m}$ a partial time series of second speech parameter vectors $\{\Delta_i\}_{p \ldots q}$, wherein:

each vector $\Delta_i$ of the partial time series of second speech parameter vectors corresponds to an identically indexed vector $x_i$ in the partial time series of first speech parameter vectors;

convert the partial time series of first speech parameter vectors $\{x_i\}_{p \ldots q}$ and the partial time series of second speech parameter vectors $\{\Delta_i\}_{p \ldots q}$ into a partial time series of corresponding third speech parameter vectors $\{y_i\}_{p \ldots q}$, so as to:

minimize differences between respective third speech parameter vectors $y_i$ of the partial time series of third speech parameter vectors $\{y_i\}_{p \ldots q}$ and their corresponding first speech parameter vectors $x_i$ of the partial time series of first speech parameter vectors $\{x_i\}_{p \ldots q}$;

minimize differences of dynamic characteristics between respective third speech parameter vectors $y_i$ of the partial time series of third speech parameter vectors $\{y_i\}_{p \ldots q}$ and their corresponding second speech parameter vectors $\Delta_i$ of the partial time series of second speech parameter vectors $\{\Delta_i\}_{p \ldots q}$;

wherein the conversion of the partial time series of first speech parameter vectors $\{x_i\}_{p \ldots q}$ and the partial time series of second speech parameter vectors $\{\Delta_i\}_{p \ldots q}$ is performed independent of converting any other first speech parameter vector $\{x_i\}_{1 \ldots p-1, q+1 \ldots m}$; and generate a speech utterance from the time series of third speech parameter vectors $\{y_i\}_{p \ldots q}$.

22. A speech synthesizer system, comprising:

a processor configured to receive an input time series of m first speech parameter vectors $\{x_i\}_{1 \ldots m}$, wherein:

index i takes on values from 1 to m;

each first speech parameter vector $x_i$ corresponds to an identically indexed one of m synchronisation points, which are also indexed by i;

each synchronisation point defines at least one of a point in time and a time interval of the speech utterance; and each first speech parameter vector $x_i$ includes a first number $n_1$ of static speech parameters of a time interval of the speech utterance;

a processor configured to prepare at least one input time series of m second speech parameter vectors $\{\Delta_i\}_{1 \ldots m}$, wherein:

each second speech parameter vector $\Delta_i$ corresponds to an identically indexed one of the synchronisation points; and each second speech parameter vector $\Delta_i$ includes a second number $n_2$ of dynamic speech parameters of a time interval of the speech utterance;

processor configured to extract from the input time series of first speech parameter vectors $\{x_i\}_{1 \ldots m}$ a partial time series of first speech parameter vectors $\{x_i\}_{p \ldots q}$, wherein:

p is the index of the first extracted first speech parameter vectors;

q is the index of the last of the extracted first speech parameter vector and the partial time series of first speech parameter vectors $\{x_i\}_{p \ldots q}$ is a proper subset of the input time series of first speech parameter vectors $\{x_i\}_{1 \ldots m}$;

a processor configured to extract from the input time series of second speech parameter vectors $\{\Delta_i\}_{1 \ldots m}$ a partial time series of second speech parameter vectors $\{\Delta_i\}_{p \ldots q}$, wherein:

each vector $\Delta_i$ of the partial time series of second speech parameter vectors corresponds to an identically indexed vector $x_i$ in the partial time series of first speech parameter vectors;

a processor configured to convert the partial time series of first speech parameter vectors $\{x_i\}_{p \ldots q}$ and the partial time series of second speech parameter vectors $\{\Delta_i\}_{p \ldots q}$ into a partial time series of corresponding third speech parameter vectors $\{y_i\}_{p \ldots q}$, so as to:

minimize differences between respective third speech parameter vectors $y_i$ of the partial time series of third speech parameter vectors $\{y_i\}_{p \ldots q}$ and their corresponding first speech parameter vectors $x_i$ of the partial time series of first speech parameter vectors $\{x_i\}_{p \ldots q}$;

minimize differences of dynamic characteristics between respective third speech parameter vectors $y_i$ of the partial time series of third speech parameter vectors $\{y_1\}_{p \ldots q}$ and their corresponding second speech parameter vectors $\Delta_i$ of the partial time series of second speech parameter vectors $\{\Delta_i\}_{p \ldots q}$; and wherein the conversion of the partial time series of first speech parameter vectors $\{x_i\}_{p \ldots q}$ and the partial time series of second speech parameter vectors $\{\Delta_i\}_{p \ldots q}$ is performed independent of converting any other first speech parameter vector $\{x_i\}_{1 \ldots p-1, q+1 \ldots m}$; and a synthesizer configured to generate a speech utterance from the time series of third speech parameter vectors $\{y_i\}_{p \ldots q}$.

* * * * *